US007569529B2

(12) United States Patent
Frankenbach

(10) Patent No.: US 7,569,529 B2
(45) Date of Patent: Aug. 4, 2009

(54) METHOD OF USING FABRIC CARE COMPOSITIONS TO ACHIEVE A SYNERGISTIC ODOR BENEFIT

(75) Inventor: Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 366 days.

(21) Appl. No.: 11/511,768

(22) Filed: Aug. 29, 2006

(65) Prior Publication Data

US 2007/0050915 A1 Mar. 8, 2007

Related U.S. Application Data

(60) Provisional application No. 60/714,793, filed on Sep. 7, 2005.

(51) Int. Cl.
*C11D 3/50* (2006.01)

(52) U.S. Cl. ..... 510/101; 512/2; 512/27

(58) Field of Classification Search ..... 510/101; 512/2, 27

See application file for complete search history.

(56) References Cited

U.S. PATENT DOCUMENTS

| | | | | |
|---|---|---|---|---|
| 5,531,910 | A | 7/1996 | Severns et al. | |
| 5,958,870 | A | 9/1999 | Declercq et al. | |
| 5,965,766 | A | 10/1999 | Chong et al. | |
| 6,093,691 | A | 7/2000 | Sivik et al. | |
| 6,147,037 | A | 11/2000 | Gardlik et al. | |
| 6,150,310 | A | 11/2000 | Sivik et al. | |
| 6,156,710 | A | 12/2000 | Sivik et al. | |
| 6,165,953 | A | 12/2000 | Gardlik et al. | |
| 6,227,796 | B1 | 5/2001 | Markovitch | |
| 6,239,087 | B1 | 5/2001 | Mao et al. | |
| 6,316,397 | B1 | 11/2001 | Sivik | |
| 6,764,986 | B1 * | 7/2004 | Busch et al. | 510/101 |
| 2003/0134772 | A1 | 7/2003 | Dykstra et al. | |
| 2006/0014655 | A1 * | 1/2006 | Smets et al. | 510/101 |

FOREIGN PATENT DOCUMENTS

| | | | |
|---|---|---|---|
| WO | WO 95/08976 | | 4/1995 |
| WO | WO 99/16740 | | 4/1999 |
| WO | WO 99/16801 | | 4/1999 |
| WO | WO 99/43639 | | 9/1999 |
| WO | WO 00/02981 | A3 | 1/2000 |
| WO | WO 00/02982 | A3 | 1/2000 |
| WO | WO 00/02986 | A3 | 1/2000 |
| WO | WO 00/02987 | A3 | 1/2000 |
| WO | WO 00/02991 | | 1/2000 |
| WO | WO 00/18864 | | 4/2000 |
| WO | WO 00/18865 | | 4/2000 |
| WO | WO 00/18897 | | 4/2000 |
| WO | WO 01/34753 | A1 | 5/2001 |
| WO | WO 01/51599 | A1 | 7/2001 |
| WO | WO 01/91721 | A3 | 12/2001 |

* cited by examiner

*Primary Examiner*—John R Hardee
(74) *Attorney, Agent, or Firm*—David V. Upite

(57) ABSTRACT

The use of a first fabric care composition comprising a first perfume delivery agent to treat a fabric and subsequently and independently treating the fabric using a second fabric care composition comprising a second perfume delivery agent provides a synergistic odor benefit on the fabric.

8 Claims, 1 Drawing Sheet

| Run Number | Total ng (d-damascone + amyl cinnamic aldehyde)/ g fabric |
|---|---|
| 1 | 2 |
| 2 | 15 |
| 3 | 2.3 |
| 4 | 28.5 |

METHOD OF USING FABRIC CARE COMPOSITIONS TO ACHIEVE A SYNERGISTIC ODOR BENEFIT

CROSS REFERENCE TO RELATED APPLICATION(S)

This application claims the benefit of U.S. Provisional Application No. 60/714,793, filed Sep. 07, 2005.

TECHNICAL FIELD

The present invention relates to the use of at least two fabric care compositions to achieve a synergistic odor benefit to fabric.

BACKGROUND OF THE INVENTION

Many inventions disclose the use of a perfume delivery agent in a fabric care product, e.g. detergent, liquid fabric softener, dryer delivered fabric softener, softener spray, etc. to improve odor delivery to fabrics. See e.g., U.S. Pat. Nos. 5,531,910; 6,156,710; 6,093,691; 6,277,796; 6,239,087; 6,165,953; 5,965,766; 6,316,397; 6,147,037; 6,150,310; 5,958,870; and international patent applications: WO 99/16740; WO 99/43639; WO 01/91721; WO 95/08976; WO 00/02986; WO 00/18864; WO 00/18865; WO 01/51599; WO 01/34752; WO 99/16801; WO 00/02991; WO 00/02981; WO 00/18897; WO 00/02987; and WO 00/02982.

The odor impression on fabrics is a key attribute driving consumer acceptance and preference for fabric care compositions and so there is a continuing need to improve perfume delivery on fabric. Specifically, there is a need to use two fabric care compositions sequentially and independently wherein the first fabric care composition comprises a first component of a perfume deliver system and the second fabric care composition comprising a second component of the perfume deliver system, such that a synergistic improvement in fabric odor benefit is achieved.

SUMMARY OF THE INVENTION

The present invention attempts to address this need by providing, in one aspect of the invention, a method of obtaining a synergistic odor benefit on fabric comprising the steps:

(a) treating the fabric with a first fabric care composition ("FFCC"), wherein the FFCC comprises a first perfume deliver agent ("FPDA");

(b) treating the fabric with a second fabric care composition ("SFCC") subsequent to the fabric being treated with the FFCC, wherein the SFCC comprises a second perfume deliver agent ("SPDA");

wherein the FPDA comprises an amine-based compound having a molecular weight of at least 100 Daltons, wherein at least 10% of the amino groups in the amine-based compound are primary amino groups; and wherein the SPDA is chosen from (i) a Schiff base compound comprising an odor detection threshold above about at least 1 part per trillion (hereinafter "ppt");

(ii) a two component system comprising a first component that comprises an amine moiety having a $pK_a$ below about 6, and a second component comprising a carbonyl moiety, wherein at least one of the two components comprise an odor detection threshold above of at least about 1 ppt; and (iii) a combination thereof

DETAILED DESCRIPTION OF THE INVENTION

Figure 1:
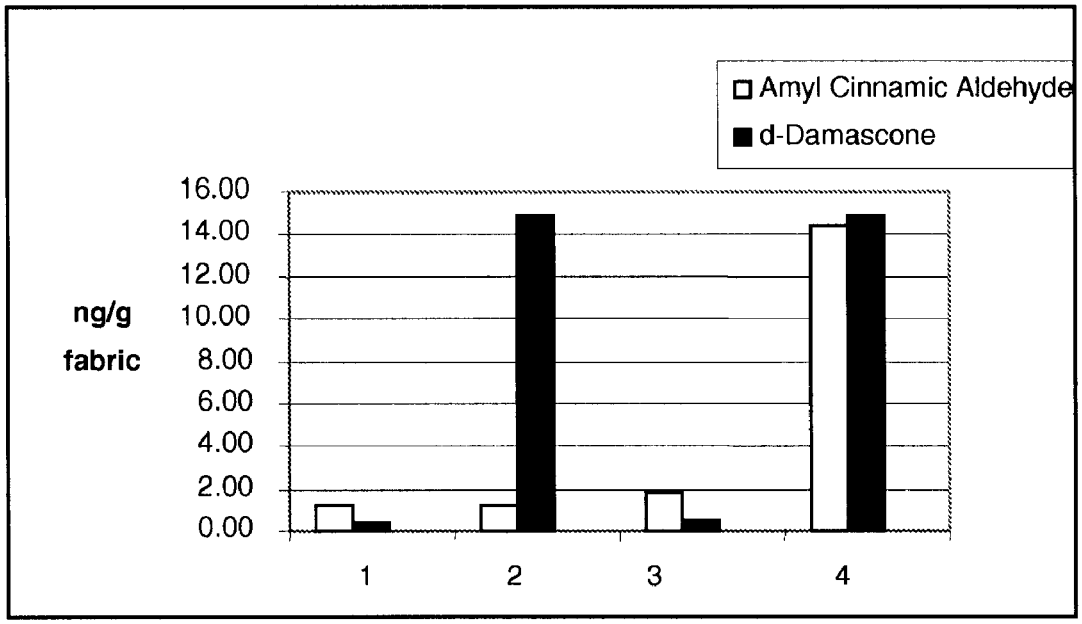
FIG. 1 is a graph of the results of analyzing fabric for deposition of perfume components.

The present invention is directed to treating fabric with the use of a first and second fabric care composition, wherein the compositions comprises a first perfume delivery agent and a second perfume delivery agent, respectively, wherein the use of the compositions provide the fabric a synergistic odor benefit. The term "synergistic odor benefit" means is an analytically measurable increase in the mass of the perfume components deposited on treated fabric that is more than additive.

A. COMPOSITIONS

One aspect of the invention provides a first fabric care composition ("FFCC") comprising a first perfume delivery agent ("FPDA"). A second aspect of the invention provides a second fabric care composition ("SPCC") comprising a second perfume delivery agent ("SPDA"). In one embodiment, the FFCC is free or essentially free of a SPDA. In a second embodiment, the SPCC is free or essentially free of a FPDA.

Another aspect of the invention provides treating a fabric with a first and second composition. The term "treating a fabric" means that the fabric is exposed to a composition of the present invention and preferably the composition deposits onto a surface of the fabric a component of a perfume delivery agent. To this end, there are a number of formats the compositions may be used to treat fabric including, but not limited to, liquid, solids, gel and can be delivered via hand dosing, unit dosing, dosing from a substrate, spraying and automatic dosing from a laundry washing or drying machine.

In one embodiment of the invention, the first composition comprises a detersive laundry surfactant. In such an embodiment, the composition functions as a. laundry detergent, wherein the composition is dosed during the washing cycle of an automatic laundry machine operation, thereby treating the fabric during the washing cycle. One skilled in the art will readily appreciate that a detersive laundry surfactant may comprise an anionic surfactant, nonionic surfactant, cationic surfactant, zwitterionic surfactant, or combination thereof. Notwithstanding the FPDA, non-limiting examples of laundry detergent compositions suitable as the first composition of the present invention may include: US 2003/0158073A1; and U.S. Pat. Nos. 6,602,845; 6,890,894; 6,395,701; and 6,916,777.

In another embodiment, the second composition comprises a fabric softening active. In such an embodiment, the composition functions as a fabric softening composition or a so called fabric softener. In such an embodiment, the second composition is dosed during the rinse cycle of an automatic laundry machine operation, thereby treating the fabric during the rinse cycle. One skilled in the art will readily appreciate that a fabric softening active may comprise a quaternary or polyquaternary ammonium compound, a silicone comprising compound, a polysaccharide, or a combination thereof. Notwithstanding the SPDA, non-limiting examples of fabric softening actives may include those described in US 2004/0204337 A1, paragraphs 16-79. Non-limiting examples of fabric softening compositions may include: US 2004/0023830; WO 2004/087854; US 2005/0065059; EP 1370634; US 2002/020035053; U.S. Pat. Nos. 6,608,024; 6,916,781; WO 99/550953; U.S. Pat. No. 6,875,735; WO 99/27050; U.S. Pat. Nos. 6,908,962; 6,491,840; and 6,818,610.

In a first embodiment of the present invention, the first composition is in the format of a spray wherein the fabric is sprayed before the fabric is laundered in an automatic laundry machine. In the first embodiment, the fabric is treated by a second composition, wherein the second composition comprises a laundry detergent composition. In a second embodiment, the first composition is a laundry detergent composition, and the second composition is a spray composition. In the second embodiment, the fabric is sprayed after the fabric is removed from the laundry washing machine and has gone through all the cycles of an automatic laundry machine operation. In a third embodiment, the first composition is a laundry detergent composition and the second composition is a dryer sheet composition, wherein the fabric is treated by the second composition via an automatic dryer machine. In yet a fourth embodiment, the first composition is a dryer sheet composition, and the second composition is a spray composition. In the fourth embodiment, the fabric is sprayed with the second composition after the fabric is dried via an automatic laundry dryer. Alternatively the second composition is spray composition wherein the composition is sprayed as a "refreshening spray," that is, the fabric is sprayed periodically during wear of the fabric.

B. PERFUME DELIVERY AGENTS

The present invention provides a FPDA and a SPDA. The FPDA comprises an amine-based compound having a molecular weight of at least 100 Daltons, wherein at least 10%, alternatively at least 20%, alternatively not greater than 90%, of the amino groups in the amine-based compound are primary amino groups.

The amine based compound which is part of the FPDA is a polyamine so long as its molecular weight is greater than 100 Daltons, preferably at least about 150 Daltons, and so long as at least 10%, preferably 15% to 80%, of its amino groups are primary amino groups.

Suitable primary amines, aminoaryl, polyamine, amino acids, substituted amines or amides, polyethylenimines and/or polypropylenimine dendrimers, polyamino acid, amino functional polymer, and amine compounds, of the present inventions may include those described in US 2003/0134772 A1

In one embodiment, the FFCC comprises from about 0.01% to about 0.5%, of the FPDA by weight of the FFCC.

The SPDA of the present invention is chosen from: (1) a Schiff base compound comprising an odor detection threshold above about at least 1 part per trillion (hereinafter "ppt"); (2) a two component system comprising a first component that comprises an amine moiety having a $pK_a$ below about 6, and a second component comprising a carbonyl moiety, wherein at least one of the two components comprise an odor detection threshold above of at least about 1 ppt; and (3) a combination thereof.

In one embodiment, the SFCC comprises from about 0.01% to about 0.5%, of the SPDA by weight of the FFCC.

Schiff Bases

One embodiment of the present invention, the SPDA comprises a Schiff base composition. Schiff bases suitable for the present invention are made via a condensation reaction between a compound comprising an amine moiety and a compound comprising a carbonyl moiety resulting in a single compound having a double bond between a carbon atom and a nitrogen atom. Schiff bases comprise the following structure:

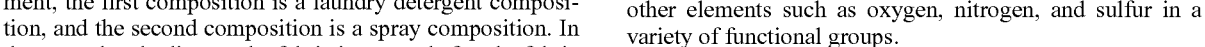

$$R(R_1)C{=}N{-}R_2 \quad \text{(i)}$$

wherein R, $R_1$, and $R_2$ are hydrogen or hydrocarbyl moieties that may be the same or different. The hydrocarbyl moieties may be linear, branched, cyclic, aromatic or non-aromatic. These hydrocarbyl moieties R, $R_1$, and $R_2$ in addition to comprising carbon and hydrogen may optionally comprise other elements such as oxygen, nitrogen, and sulfur in a variety of functional groups.

Preferred Schiff bases of the present invention may include reaction products of all the following amines: methyl anthranilate, hexyl anthranilate, nonyl anthranilate, and ethyl anthranilate, indol, skatole, as well as all isomers and derivatives of said amines.

A non-limiting selection of Schiff bases suitable for the present invention are given in Table 1 below.

TABLE 1

Non-limiting Examples of Preferred Schiff Bases.

| Aldehyde Reagent | Amine Reagent | Trade Name of Resultant Schiff Base |
|---|---|---|
| Triplal | Ethyl anthranilate | Agrea |
| Triplal | Methyl anthranilate | Agrumea |
| Hydroxycitronellal | Methyl anthranilate | Auralava |
| Cuminaldehyde | Methyl anthranilate | Citronama |
| Cumialdehyde | Ethyl anthranilate | Cumea |
| Decanal | Methyl anthranilate | Decimea |
| Hydroxycitronellal | Indol | Indolene 50 |
| Phenylacetaldehyde | Indol | Indophal Extra 50 |
| Amyl cinnamic aldehyde | Methyl anthranilate | Jasmea |
| Hexyl cinnamic aldehyde | Methyl anthranilate | Jasmea H |
| Cyclamen aldehyde | Methyl anthranilate | Lilanthol |
| Lyral | Methyl anthranilate | Lyrame Super C |
| Lilial | Methyl anthranilate | Maranthra |
| Methyl nonyl acetaldehyde | Methyl anthranilate | Menthama |
| Isononyl aldehyde | Methyl anthranilate | Naame |
| n-Nonyl aldehyde | Methyl anthranilate | Nonimea |
| Aldehyde C-8 (n-octyl) | Methyl anthranilate | Ocmea |
| Vanillin | Methyl anthranilate | Vananthra |
| Citral | Methyl anthranilate | Lemma |
| Lyral | Indol | Lyrindole 50 |
| Hydroxycitronellal | Skatole | Skatolene 50 |
| Isocyclocitral | Methyl anthranilate | Isocitromea |
| Aldehyde C-12 (lauric) | Methyl anthranilate | Laurea |

Two Component Systems

In one embodiment, the SPDA comprises a two component system comprising a first component and a second component. The first component comprises an amine moiety having a $pK_a$ below about 6, preferably below about 5. In one embodiment, the first component is a polyamine. In another embodiment, the first component comprises a compound comprising an amine and an electron withdrawing group, such as an aromatic moiety. Typical non-limiting examples of such low $pK_a$ amine species of the first component include methyl anthranilate, hexyl anthranilate, nonyl anthranilate, ethyl anthranilate, or combinations thereof. In yet another embodiment, the amine moiety of the first component of the two component system comprises:

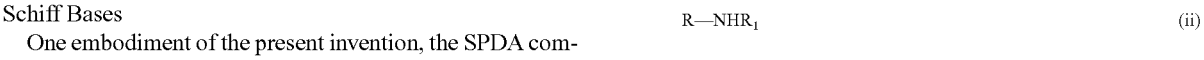

$$R{-}NHR_1 \quad \text{(ii)}$$

wherein R is an aromatic ring that may be substituted or unsubstituted. Typical non-limiting examples of a compound of formula (ii) may include: methyl anthranilate, hexyl anthranilate, nonyl anthranilate, and ethyl anthranilate.

The second component, of the two component system of the SPDA, comprises a compound comprising a carbonyl moiety, typically a conjugated or non-conjugated aldehyde or a ketone In one embodiment, at least one of the components, of the two component system, comprises an odor detection threshold above about 1 ppt.

In another embodiment, fabric is treated with a FFCC independent of and/or before the fabric is treated with a SFCC.

B. INSTRUCTIONS FOR USE

One aspect of the present invention provides an article comprising: at least one of the compositions of the present invention; and instructions for treating fabric with a FFCC independent of and/or before the fabric is treated with a SFCC. In one embodiment, the instructions instruct the user to treat the fabric with a FFCC and subsequently treating the fabric with a SFFC, preferably the instructions instruct the use of the synergistic odor benefit achieved by using the FFCC and SFFC in the method described.

In one embodiment, the instructions instruct the user the odor benefit may be described in a variety of fashions including an increase in intensity, freshness, longevity, improved character, or combinations thereof. The user may be instructed that the odor benefit is dependent on using the products together. The benefit may also be described via a variety of phrases that communicates the necessity of utilize the two products together in one fabric care process to achieve the desired benefit. Non-limiting examples of language that communicates the necessity of using the FFCC and SFCC together in a fabric care treatment regimen (e.g., washing and rinsing fabric) include: phrases using the terms "lock & key." In another embodiment, the instructions instruct the user the necessity of communicating the appropriate sequence of treating fabric with the FFCC and SFCC of the present invention.

C. EXAMPLES

This example demonstrates the synergistic odor benefit derived through the sequential use of the FFCC and SFFC of the present invention. Four fabric bundles are treated with four fabric care regimens labeled run 1, run 2, run 3, and run 4. In run 1, the fabric bundle is treated firstly with a laundry detergent, wherein the laundry detergent does not comprise a FPDA of the present invention, and secondly with a fabric softener, wherein the fabric softener does not comprise a SPDA of the present invention. In run 2, the fabric bundle is treated firstly with a laundry detergent that comprises a FPDA and secondly with a fabric softener, wherein the fabric softener does not comprise a SPDA. In run 3, the fabric bundle is treated firstly with a laundry detergent, wherein the laundry detergent does not comprises a FPDA, and secondly with a fabric softener, that comprises a SPDA. In run 4, the fabric bundle is treated firstly with a laundry detergent, wherein the laundry detergent composition a FPDA, and then secondly with a fabric softener, wherein the fabric softening comprises a SPDA. The experiment design is summarized in Table 2 below.

TABLE 2

Experiment design to demonstrate the synergistic benefit of treating fabrics with compositions of the present invention.

| Run Number | Treatments |
|---|---|
| 1 | FFCC = Laundry detergent without a FPDA |
| | SFCC = Fabric softener without a SPDA |
| 2 | FFCC = Laundry detergent with a FPDA |
| | SFCC = Fabric softener without a SPDA |
| 3 | FFCC = Laundry detergent without a FPDA |
| | SFCC = Fabric softener with a SPDA |
| 4 | FFCC = Laundry detergent with a FPDA |
| | SFCC = Fabric softener with a SPDA |

The FFCC is a laundry detergent comprising the following ingredients:

| Component | Amount Active by Weight in Formula |
|---|---|
| C12-14 AE1.8S (1) | 8.50% |
| C11.8 LAS (2) | 1.50% |
| Neodol 23-9 (3) | 1.60% |
| Trisodium Citrate | 2.50% |
| C12-18 Real Soap (4) | 0.4% |
| Solvents (5) | 5.50% |
| DTPA (6) | 0.30% |
| DC5210 (7) | 0.05% |
| NaOH | 1.65% |
| Perfume | 0.2-0.4% |
| FPDA (8) | 0.023% |
| Water | Balance |

(1) Sodium alkyl ethoxylated sulfate with a 12-14 chain length distribution and 1.8 moles ethoxylation on average.
(2) Alkyl benzene sulfonic acid with a C10-16 chain length distribution available from Stepan Co.
(3) Alkyl ethoxylate with a C12-14 chain length distribution and an average of nine moles ethoxylate available from Shell.
(4) Fatty acid with C12-18 alkyl chain length distribution
(5) One or a combination of the following solvents: ethanol mono-ethanolamine, propylene glycol, and diethylene glycol.
(6) Diethylenetriaminepentaacetic acid.
(7) Silicone suds suppressor from Dow Corning.
(8) When the laundry detergent comprises the first PDA, the composition of the PDA is the following: 0.01% N4 amine (Bis-3-aminopropyl) ethylene diamine (from BASF Canada) + a perfume that comprises 0.013% delta damascone by weight of the formula and the balance of water in the liquid laundry detergent is adjusted to accommodate these elements.

| Component | Amount Active by Weight in Formula |
|---|---|
| DEEDMAC (1) | 16% |
| Perfume | 1.4235% |
| SPDA (2) | 0.0765% |
| DC 2310 (3) | 0.015% |
| DTPA (4) | 0.007% |
| $CaCl_2$ (25% active) | 0.070% |
| $NH_4Cl$ | 0.1% |
| HOE S 4060 (5) | 0.16% |

-continued

| Component | Amount Active by Weight in Formula |
|---|---|
| Preservative (6) | 7.5 ppm |
| Water | balance |

(1) N,N-di(tallowoyloxyethyl)-N,N-dimethylammonium chloride
(2) When the composition comprises a second PDA this is 0.072% Jasmea ® (available from IFF) + 0.0045% methyl anthranilate (Aldrich) by weight of the formula.
(3) Silicone antifoam agent available from Dow Corning Corp.
(4) Diethylenetriaminepentaacetic acid.
(5) Copolymer of ethylene oxide and terephthalate having the formula described in U.S. Pat. No. 5,574,179 at col. 15, lines 1-5, wherein each X is methyl, each n is 40, u is 4, each $R^1$ is essentially 1,4-phenylene moieties, each $R^2$ is essentially ethylene, 1,2-propylene moieties, or mixtures thereof.
(6) KATHON ® CG available from Rohm and Haas Co.

Method for Treating Fabrics with FFCC and SFCC.

A fabric bundle comprising (9) 100% cotton crew neck t-shirts, (7) 50/50 polycotton pillow cases, (6) 86/14 cotton-poly terry cloth hand towels, and (6) 100% cotton terry cloths hand towels. The total weight of this load of fabrics is 2.8-3.0 kg. This load of fabrics is added to a top loading washing machine and the washing machine is set on a cotton sturdy or normal fabric cycle for washing. The washing machine is filled with 64.4 L of water and 96.9 g of the laundry detergent composition is added to the water just after the washing machine is filled. The temperature of the wash water is 32° C. Following the wash, the fabrics go through a spin cycle that extracts excess water. After the spin cycle, the washing machine process is paused and fabrics are removed from the washing machine and stored on a clean surface.

The washing machine process is resumed until the washing machine fills with 64.4 L of water at a temperature of 15-16° C. for the rinse cycle. The rinse cycle is paused after the machine fills. A 30.45 g dose of the fabric softener composition is diluted with 30 g water and added to the rinse cycle and dispersed by manually agitating the water. The fabric bundle is added back into the washing machine and the rinse cycle is resumed. Following the spin cycle to extract excess water from the fabrics, the fabrics are placed in a an automatic dryer and dried for 50 minutes on the high or hot cycle with a 10 minute cool-down period.

Method for Analyzing Fabrics for Deposition of Perfume Components

Fabrics are thermally desorbed to remove perfume components for analysis. For this technique, a 1 gram swatch is removed from the center of the fabric and packed into a glass tube 35 cm in length by 1 cm internal diameter. The tube is heated to 120° C. while purging for 30 minutes with 50 mL/min dry helium. The perfume is collected on a trap containing Tenax TA absorbent and the trap is subsequently analyzed via Thermal Desorption-Cryo-focusing/GC/MS for identification and quantitation.

The graph of FIG. 1 demonstrates that when the fabric is treated sequentially and independently with a FFCC, wherein the FFCC comprises a FPDA, and then a SFCC, wherein the SFCC comprises a FPDA, more than additive amount of odor components (d-damascone+amyl cinnamic aldehyde) from the perfume deliver agent is deposited on the fabric, i.e., a synergistic odor benefit is demonstrated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of obtaining a synergistic odor benefit on fabric comprising the steps:

(a) treating the fabric with a first fabric care composition ("FFCC"), wherein the FFCC comprises a first perfume deliver agent ("FPDA");

(b) treating the fabric with a second fabric care composition ("SFCC") subsequent to the fabric being treated with the FFCC, wherein the SFCC comprises a second perfume deliver agent ("SPDA");

wherein the FPDA comprises a perfume and an amine-based compound having a molecular weight of at least 100 Daltons, wherein at least 10% of the amino groups in the amine-based compound are primary amino groups; and wherein said amine-based compound is chosen from aminoaryl derivatives, polyamines, amino acids and derivatives thereof, substituted amines and amides, glucamines, dendrimers, polyvinylamines and derivatives thereof, and/or copolymer thereof, alkylene polyamine, polyaminoacid and copolymer thereof, cross-linked polyaminoacids, amino substituted polyvinylalcohol, polyoxyethylene bis amine or bis aminoalkyl, aminoalkyl piperazine and derivatives thereof, bis(amino alkyl)alkyl diamine linear or branched, and mixtures thereof;

wherein the SPDA is chosen from (i) a Schiff base compound comprising a perfume having an odor detection threshold above about at least 1 part per trillion (hereinafter "ppt");

(ii) a two component system comprising a first component that comprises an amine moiety having a $pK_a$ below about 6, and a second component comprising a perfume comprising a carbonyl moiety, wherein at least one of the two components comprise an odor detection threshold above of at least about 1 ppt; and (iii) a combination thereof.

2. The method of claim 1, wherein the SPDA is a Schiff base compound comprising an odor detection threshold above about at least 1 part per trillion.

3. The method of claim 1, wherein the SPDA is a two component system comprising a first component that comprises an amine moiety having a $pK_a$ below about 6, and a second component comprising a perfume comprising a carbonyl moiety, wherein at least one of the two components comprise an odor detection threshold above of at least about 1 ppt.

4. The method of claim 1, wherein said amine-based compound having a molecular weight of at least 150 Daltons, wherein at least 20% of the amino groups in the amine-based compound are primary amino groups.

5. The method of claim 4, wherein said amine-based compound having a molecular weight of at least 150 Daltons, wherein from 20% to 90% of the amino groups in the amine-based compound are primary amino groups.

6. The method of claim 1, wherein from 10% to 90% of the amino groups in the amine-based compound are primary amino groups.

7. The method of claim 1, wherein the first fabric care composition is a laundry detergent.

8. The method of claim 1, wherein the second fabric care composition is a laundry detergent.

* * * * *

UNITED STATES PATENT AND TRADEMARK OFFICE

CERTIFICATE OF CORRECTION

PATENT NO. : 7,569,529 B2
APPLICATION NO. : 11/511768
DATED : August 4, 2009
INVENTOR(S) : Frankenbach et al.

It is certified that error appears in the above-identified patent and that said Letters Patent is hereby corrected as shown below:

Title Page

(75) Inventor, insert the following additional inventors:

--Zaiyou Liu, West Chester, OH (US)

Kristin Marie Finley, Milford, OH (US)

Thomas Jackson Kirk, Cincinnati, OH (US)

George Kavin Morgan, III, Hamilton, OH (US)--.

Column 2

Line 41, after the word a delete the ".".

Column 6

Line 55, insert the heading --The SFCC is a fabric softener comprising the following ingredients:--.

Signed and Sealed this

Thirteenth Day of April, 2010

David J. Kappos

David J. Kappos
*Director of the United States Patent and Trademark Office*